United States Patent [19]

Rogerson

[11] 4,246,739

[45] Jan. 27, 1981

[54] FISH SIZING DEVICE

[76] Inventor: John R. Rogerson, P.O. Box 10, Leonardville, Canada, EOG 2GO

[21] Appl. No.: 52,129

[22] Filed: Jun. 25, 1979

[51] Int. Cl.[3] ..... B65B 1/24; B65B 63/02; B65B 1/30

[52] U.S. Cl. ..... 53/438; 53/446; 53/504; 53/143; 53/244; 193/31 A

[58] Field of Search ..... 53/438, 446, 475, 503, 53/504, 529, 142, 143, 244; 100/49

[56] References Cited

U.S. PATENT DOCUMENTS

| | | | |
|---|---|---|---|
| 3,313,394 | 4/1967 | Mills et al. | 53/446 |
| 3,408,926 | 11/1968 | Rogerson | 53/143 X |

*Primary Examiner*—Travis S. McGehee

*Attorney, Agent, or Firm*—Clarence A. O'Brien; Harvey B. Jacobson

[57] ABSTRACT

A bifurcated funnel presents small fish in alternating orientation to a canning apparatus. The canning apparatus is moved incrementally forward to receive the oncoming fish by a distance equivalent to the width of that individual fish. A flap is disposed in the funnel and each fish displaces the flap by a distance equivalent to its width. The flap is connected to a ratchet wheel which contains electrical contacts for actuating a plurality of solenoids which determine the position of a stop mechanism for the canning apparatus. The distance of movement of the ratchet wheel is designed in accordance with the size of the apparatus which is to receive the fish. When the ratchet wheel moves its total allotted distance, a set of contacts resets the ratchet wheel and the canning apparatus.

13 Claims, 5 Drawing Figures

Fig. 2
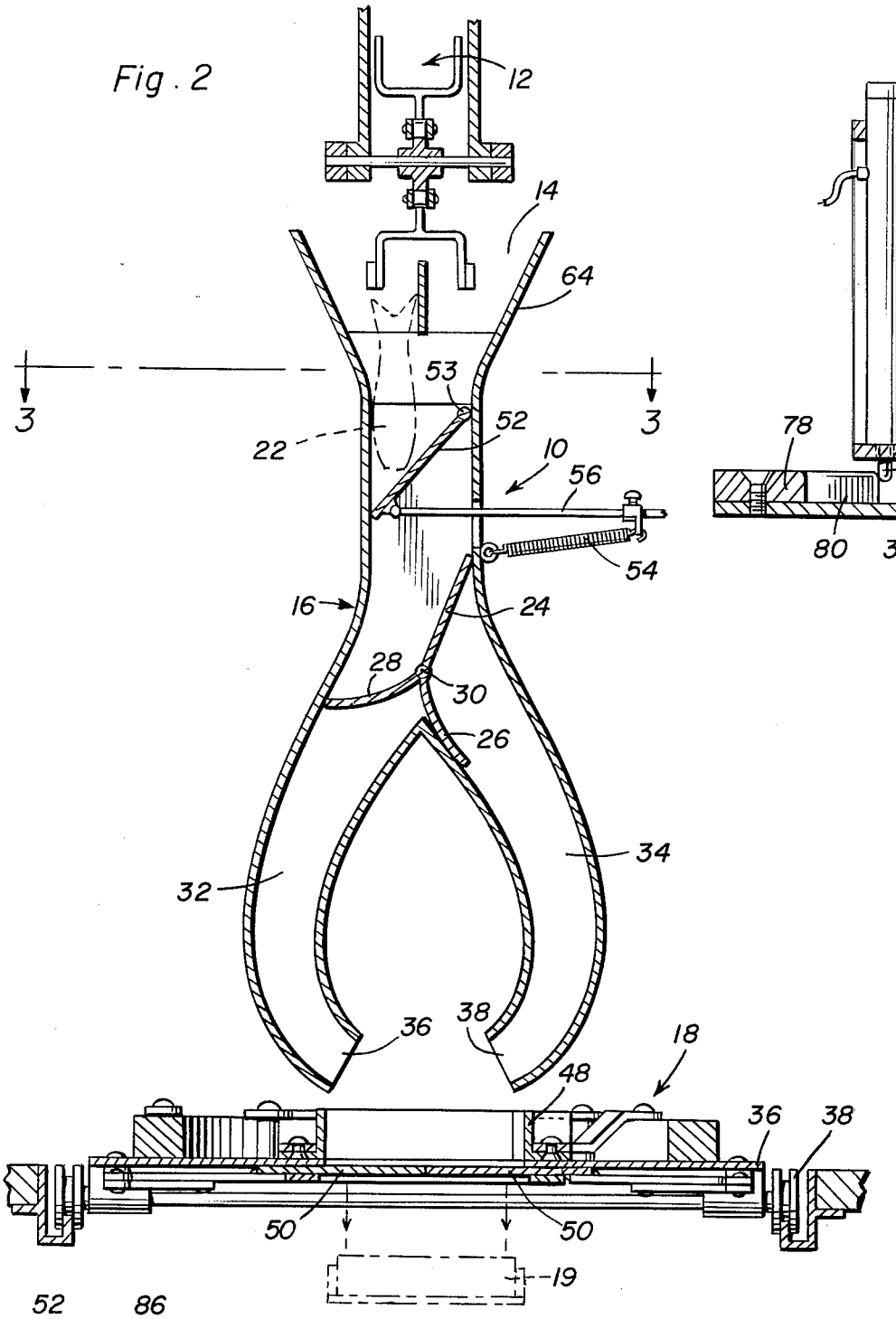
Fig. 4
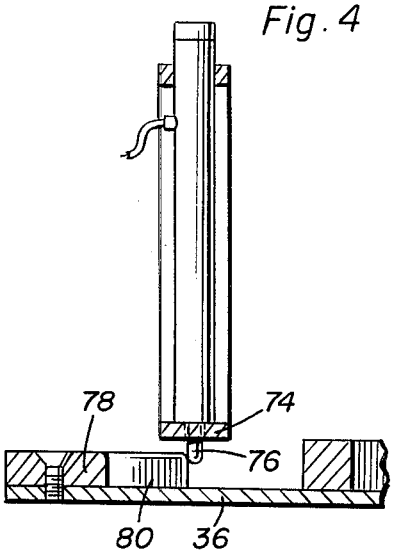
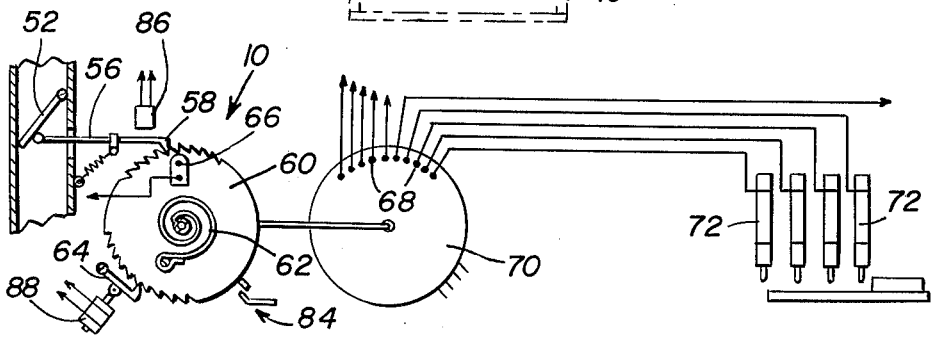
Fig. 5

FISH SIZING DEVICE

BACKGROUND OF THE INVENTION

1. Field of the Invention

This invention relates to fish packing machinery and especially to devices for incrementally moving the canning apparatus associated with such machinery for packing fish according to the fish size.

2. Discussion of Related Art

The preparation and the packaging of food products is presently a major industry. Naturally, it is desirable to mechanize as many of the operations involved in such preparation and packing as is feasible without loss of quality to the packaged goods. In the fish industry, it is therefore customary to mechanize the entire process of canning of the fish. This requires that the fish being packaged conform to the preconfigured container made available. Accordingly, the fish are customarily cut and pressed in forms for this purpose. For instance, U.S. Pat. No. 3,164,857, issued Jan. 12, 1965 to Sennello, shows a fish canning control apparatus which uses movable sensors disposed on a fish conveying means for determining the quantity of fish on the conveying means in order that the speed of the cutting apparatus can be varied in accordance therewith. U.S. Pat. No. 2,542,133, issued Feb. 20, 1951 to Gorby, shows an apparatus for canning fish wherein fish fillets are cut into predetermined dimensions prior to being placed within a container.

SUMMARY OF THE INVENTION

One object of the present invention is to provide a fish sizing device for use in a fish packing machine which can accurately determine the width of fish to be placed in a container in order that the container can be advanced an amount in accordance therewith.

A further object of the present invention is to provide a fish sizing device for use in a fish packing machine which device is simple in operation and can be incorporated in already existing machinery.

A still further object of the present invention is to provide a fish sizing device for use in a fish packing machine which device can automatically advance the container until the container is substantially full at which time the device resets itself.

In accordance with the above objects, the present invention includes a flap disposed across the fish receiving unit of a fish packing machine. The flap is displaced by any fish falling therethrough. The flap is attached to an actuation arm which ratchets a control wheel forwardly. The control wheel contains one electrical contact which sequentially engages a plurality of contacts on a stationary control wheel. These stationary contacts are each connected to actuate one of a plurality of solenoids. The solenoids are disposed across the path of the fish compacting unit and have cores which extend downwardly in front of an angled cam which is attached to the movable platform on which the fish compacting unit is deployed. The angled cam contacts one core at a time and as each core is raised by its respective solenoid being electrically actuated, the movable platform advances making contact with the next sequential solenoid. The movable contact wheel is ratcheted forwardly until a pair of stops engage indicating the full extent of motion of the fish compactor device. The engagement of the stops causes release of the ratchet and a spring rotates it back to its initial position while another device moves the fish compacting mechanism to the original position.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is an elevational sectional view taken substantially along a plane passing through section line 2—2 of FIG. 1.

FIG. 4 is a side elevational sectional view taken substantially along a plane passing through section line 4—4 of FIG. 3.

FIG. 5 is a schematic representation of the control mechanism of the fish sizing device.

DESCRIPTION OF THE PREFERRED EMBODIMENT

Figure 1:
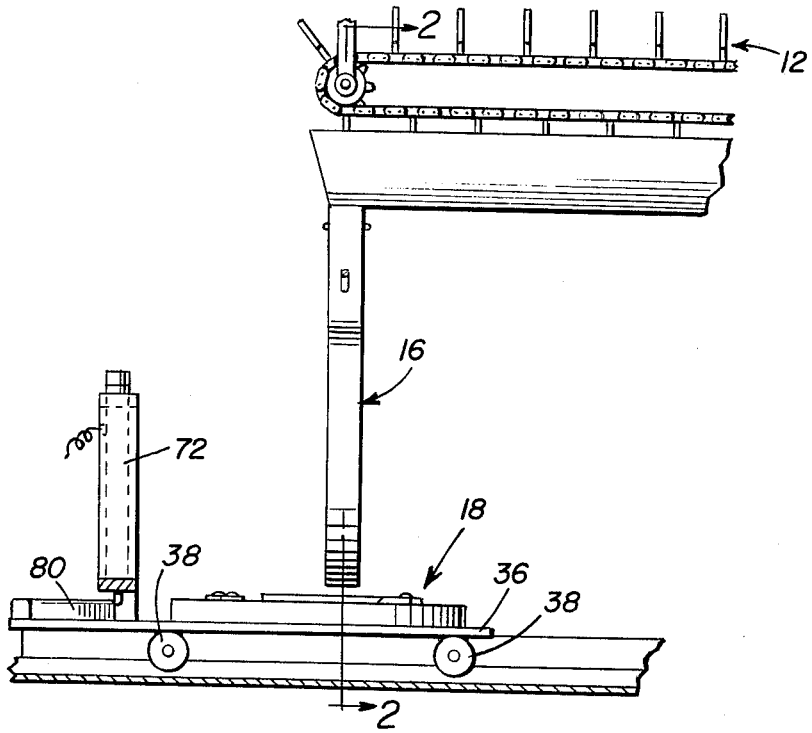
FIG. 1 is a side elevational view of the fish sizing device as incorporated in a fish packing machine.
Figure 3:
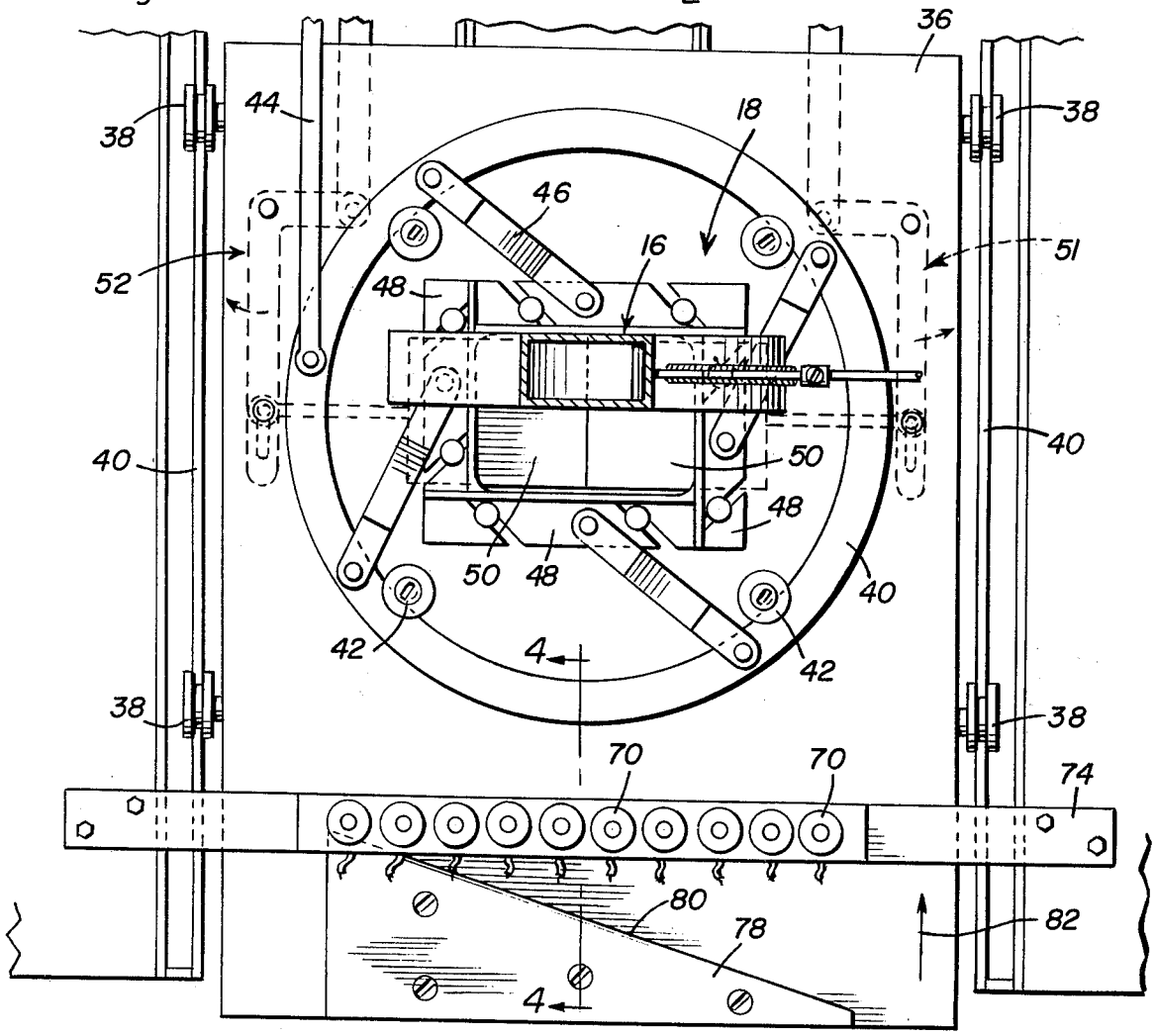
FIG. 3 is a top plan sectional view taken substantially along a plane passing through section line 3—3 of FIG. 2.

Now with reference to the drawings, a fish sizing device incorporating the principles of the present invention and generally referred to by the reference numeral 10 will be set forth in detail. The essential portions of the fish packing machine disclosed in the aforementioned U.S. Pat. No. 3,408,926, which is incorporated herein by reference thereto, are shown in FIGS. 1-3 and include a fish orienting conveyor assembly generally referred to by the reference numeral 12 having a delivery end positioned above the upper inlet end 14 of a gravity chute assembly 16. Fish delivered to the loading end (not shown) of the conveyor 12 will be conveyed and delivered to the gravity chute assembly from which the fish emerge and are deposited within a fish molding mechanism generally referred to by the reference numeral 18. Thus, a number of fish are compressed to a predetermined size by the molding mechanism 18 so that they may be deposited into containers 19 such as shown by dotted line in FIG. 2. When loaded, each container is conveyed away from the station at which the fish are compressed by the molding mechanism.

The detailed structure and the operation of the fish orienting conveyor 12 and the fish molding mechanism 18 together with the overall operation of the fish packing machine is set forth in the aforementioned U.S. Pat. No. 3,408,926 to Rogerson and any details thereof not pertinent to the operation of the fish sizing device 10 will be omitted. Referring again to FIGS. 1-3, it will be readily apparent that the gravity chute assembly 16 includes a downwardly converging portion 20 in which vertically oriented fish are received and handed down from the conveyor 12 as shown in phantom at 22. A direction changing valve member including a blade 24 and a pair of diverging veins 26 and 28 is pivotally mounted by pivot shaft 30 intermediate the upper and lower ends of the chute assembly. It will be apparent therefore that a fish received within the upper portion of the chute assembly will be directed into the conduit section 32 by the blade 24 in the position illustrated in FIG. 2. As the fish enter conduit section 32, it displaces the vanes 28 so as to pivotally displace the valve member to its other operative position in order to direct the next fish into the conduit section 34. Fish will, therefore, emerge head first in an alternating manner from the outlet ends 36 and 38 of the chute assembly and be deposited into the molding device 18 in horizontal positions.

Referring again to FIGS. 1–3, it can clearly be seen that the molding device 18 is positioned in spaced relation below the lower outlet ends of the chute assembly by means of a horizontal movable plate 36. The plate 36 mounts rotatable wheels 38 which are disposed in pairs on opposite sides of the plate and incorporate grooved surfaces which ride on longitudinally extending raised tracks 40 to allow the plate to move beneath the gravity chute. A suitable power source may be used and connected to plate 36 causing horizontal movement thereof in accordance with the mechanics of the fish sizing device as will be discussed hereinafter.

The fish molding mechanism 18 includes an annular ring 40 rotatably mounted on plate 36 by a plurality of rollers 42. An actuator arm 44 is pivotally mounted to the ring 40 and is also attached to a solenoid (not shown) for causing rotational translation of the ring. A plurality of links 46 are pivotally attached at one end to the annular ring at spaced locations about the upper surface of the ring. The opposite end of each link 46 is connected to a separate side frame member 48 for compacting fish which have been deposited within the confines of the side frame members. After the fish are compacted, doors 50 are caused to slide sideways through linkages 51 to expose an opening in movable plate 36 through which the compacted fish fall. The compacted fish are received into containers 19 disposed beneath the movable plate as shown in dotted lines in FIG. 2.

In order to increment the plate 36 according to the lateral dimensions of the fish being deposited in inlet 14, a flap 52 is disposed across the gravity chute above the position of the direction changing valve. Flap 52 is pivotally connected to the chute by shaft 53 on one end. The flap is held in angled position across the chute by tension spring 54 which is connected to rod 56 which is in turn pivotally mounted at one end to the lower end of flap 52. Accordingly, it is evident that as a fish 22 progresses through the chute, the flap 52 is displaced against the force of spring 54 by an amount equivalent to the width of the fish. As seen in FIG. 5, rod 56 contains a tooth 58 at its opposite end for engaging with complementary teeth disposed about the upper portion of movable contact wheel 60 in a ratcheting action. Obviously, when flap 52 is displaced by a fish, the tooth 58 causes wheel 60 to move clockwise against the force of spring 62. The wheel is held in position by a second tooth 64, seen in FIG. 5. Wheel 60 has a single movable contact 66. As wheel 60 is rotated, movable contact 66 sequentially engages a plurality of stationary contacts 68 which are mounted on stationary contact wheel 70. Each stationary contact 68 causes energization of separate solenoid 72 when that contact engages the movable contact.

As is most evident with respect to FIGS. 3 and 4, the solenoids 72 are disposed vertically in laterally aligned relationship across the movable plate 36. The mounting bar 74 maintains the solenoids stationary and spaced above the surface of the plate. The solenoid cores 76 depend from each solenoid and abut the face of cam member 78. Cam member 78 is fixedly attached to the movable plate 36 and has a cam surface 80 which makes physical contact with the cores and is slanted backward on plate 36. It will be noted that due to the slanted configuration of cam surface 80, that surface contacts only one core 76 at a time. Within an appropriate motive power source attached to the movable plate 36, the plate will be forced in a direction indicated by arrow 82, the movement of plate 36 being stopped by the abutment of cam surface 80 against one of the solenoid cores. Now, as movable contact 66 sequentially enages stationary contacts 68, the solenoids 72 are energized causing the cores thereof to lift to a position above the top of cam 78. Accordingly, the cam and the plate 36 move forwardly until the cam surface 80 abuts the next core 76 which is still in its depending position.

It therefore becomes evident that in operation, as seen in FIGS. 1–5 as each fish 22 is deposited in inlet 14, flap 52 through rod 56 causes clockwise rotation of movable contact wheel 60. Movable contact 66 therefore sequentially energizes a number of stationary contacts 68 in accordance with the width of fish 22. As the stationary contacts 68 are engaged, the corresponding solenoids are energized and the plate 36 moves forward a sufficient amount to receive the falling fish 22. As the wheel 60 is incrementally advanced by rod 56, it is held in its newly acquired position by tooth 64 which is spring biased toward the lower corporating teeth of the wheel while tooth 58 is being pulled to its initial position through the tension of spring 54. The incremental advancement of wheel 60 continues until contacts 84 engage. These contacts serve as a stop for wheel 60 and are positioned in accordance with the dimensions of the opening defined by side frame members 48. When contacts 84 engage, they also serve to energize solenoids 86 and 88 which serve to disengage teeth 58 and 64, respectively, from the cooperating teeth of the wheel 60. Thus allowing spring 62 to return the wheel 60 to its initial position. A signal from contacts 84 would also serve as a stop signal for conveyor 12 and as the timing signal for initiation of the fish compressing operation as set forth in detail in the aforementioned U.S. Pat. No. 3,408,926.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be restored to, falling within the scope of the invention.

What is claimed as new is as follows:

1. In a fish packing machine comprising: a fish delivery means, a chute means having an inlet disposed below said fish delivery means for receiving individual fish portions delivered by said fish delivery means, and a fish receiving means movably mounted in vertical spaced relation below said chute means for receiving individual fish portions from said chute means, the improvement comprising; fish sizing means for causing movement of said receiving means in accordance with the size of individual fish portions received in said receiving means from said chute means.

2. The apparatus of claim 1 and further wherein said fish sizing means includes a movable flap means disposed across said chute means for displacement by individual fish portions as they pass through said chute means.

3. The apparatus of claim 2 wherein said fish sizing means further includes a stop cam means disposed on said fish receiving means and movable therewith, said stop cam means cooperatively enaging one of a plurality of vertically displaceable stops, and energization means for causing said stops to be individually, sequentially raised in accordance with the position of said flap means.

4. The apparatus of claim 1 wherein said fish sizing means further includes displacement means positioned in said chute for displacement by individual fish portions, said displacement means being ratchetly connected to a contact wheel for incrementally advancing said contact wheel upon displacement of said displacement means by a plurality of individual fish portions.

5. The apparatus of claim 4 wherein said fish sizing means further includes a plurality of displaceable stops operatively engaged with said fish receiving means for limiting movement thereof, and actuation means for causing sequential actuation of individual ones of said stop means in response to incremental advancement of said contact wheel.

6. The apparatus of claim 5 wherein said actuation means comprises a plurality of solenoids and said stop means comprises the cores of said solenoids depending therefrom, and further including an angled cam face attached to said fish receiving means for contacting the cores of said solenoids one at a time, said contact wheel causing individual actuation of said solenoids for lifting said cores therey allowing said fish receiving means to advance until stopped by the next core.

7. The apparatus of claim 1 wherein said fish receiving means includes a defined space for receiving individual fish portions, and said sizing means further includes signalling means for producing an indication when said defined opening is filled.

8. The apparatus of claim 7 and further including reduction means for reducing the size of the defined opening for compacting the fish received therein.

9. The method of canning fish portions comprising the steps of:

(1) orienting the said fish portions in a common direction;

(2) measuring a common dimension of each fish portion individually;

(3) allowing each individual fish portion to fall into a receiving member; and (4) advancing said member by an amount equal to the measured diameter of each fish portion prior to receiving that fish portion.

10. The method of claim 9 wherein the step of allowing each fish portion to fall into a receiving member includes the step of oppositely orienting alternate fish portion before it enters the member.

11. The method of claim 10 including the step of halting the movement of said receiving member when said receiving member is filled with fish portions.

12. The method of claim 11 and further including the step of compacting said fish portions after said member is filled.

13. The method of claim 12 and further including the step of allowing said compacted fish portions to fall into a container.

* * * * *